United States Patent [19]

Shida et al.

[11] Patent Number: 4,484,956

[45] Date of Patent: Nov. 27, 1984

[54] PROCESS FOR PRODUCING HEAT-RESISTANT FERRITIC STAINLESS STEEL SHEET

[75] Inventors: Yoshiaki Shida, Ikoma; Hisao Fujikawa; Masao Koike, both of Nishinomiya; Junichiro Murayama, Takarazuka; Shunichiro Akiyama, Joetsu, all of Japan

[73] Assignees: Sumitomo Metal Industries, Ltd., Osaka; Nippon Stainless Steel Co., Ltd., Tokyo, both of Japan

[21] Appl. No.: 582,534

[22] Filed: Feb. 22, 1984

[30] Foreign Application Priority Data

Feb. 23, 1983 [JP] Japan ..... 58-27725

[51] Int. Cl.[3] ..... C21D 7/14

[52] U.S. Cl. ..... 148/12 EA

[58] Field of Search ..... 148/12 EA

[56] References Cited

U.S. PATENT DOCUMENTS 4,374,683 2/1983 Koike et al. ..... 148/12 EA

FOREIGN PATENT DOCUMENTS 884806 11/1971 Canada ..... 148/12 EA 0050356 4/1982 European Pat. Off. ..... 148/12 EA

*Primary Examiner*—W. Stallard

*Attorney, Agent, or Firm*—Burns, Doane, Swecker and Mathis

[57] ABSTRACT

A process for producing heat-resistant ferritic stainless steel sheet which exhibits improved toughness and productivity is disclosed. The process comprises the following steps:

(a) hot rolling a steel with a finishing temperature of not higher than 850° C., said steel comprising, by weight %, C: not more than 0.07%, Si: 1.5–3.5%, Mn: not more than 2.0%, Cr: 10–25% , N: not more than 0.05%, Nb: 5X(C %+N %)–20X(C %+N %), optionally at least one element selected from the group consisting of Al, Y, Ca, and REM in a total amount of 0.3% or less, and the balance iron and incidental impurities; and (b) annealing the resulting hot rolled steel sheet at a temperature of 820°–1000° C.

Cold rolling may be applied to the annealed hot-rolled steel sheet.

10 Claims, 2 Drawing Figures

PROCESS FOR PRODUCING HEAT-RESISTANT FERRITIC STAINLESS STEEL SHEET

BACKGROUND OF THE INVENTION

This invention relates to a process for producing a heat-resistant, ferritic stainless steel sheet, and particularly to a process characterized by applying low temperature hot rolling to a Nb-containing ferritic stainless steel with a high Si content.

Heat-resistant ferritic stainless steel has been used for producing a variety of high-temperature articles such as heating apparatuses (e.g. oil stoves and kerosine stoves), kitchen utensils, exhaust gas converters, heat-exchanging apparatuses, and boilers. For manufacturing high-temperature articles used for a purpose in which a high level of mechanical strength is not necessary, or in which the smaller the degree of thermal expansion is, the more preferable, a ferritic stainless steel is used in preference to an expensive, heat-resistant austenitic stainless steel.

Some typical ferritic stainless steels are AISI Type 430 steel, AISI Type 446 steel, Fe-Cr-Al steel (JIS SUH21 steel, "Kanthal", trade name), and Cr-Si-Al steel ("Sicromal" steel, trade name, corresponding to DIN 4724). As a material for manufacturing heating apparatuses such as oil stoves, kerosine stoves, stove chimneys, ducts therefor, AISI Type 430 steel has been widely used. However, it has a maximum service temperature of 800° C. When it is heated to a temperature higher than 800° C., abnormal oxidation rapidly occurs. In addition, it is known that 430 type steel easily gives a red oxide scale when it is heated to a temperature of around 600° C. in a combustion gas atmosphere, resulting in an oxidational metal loss, a decrease in combustion efficiency and a remarkable deterioration in appearance.

Fe-Cr-Al steels have sometimes been employed for the use described above. However, these steels employ expensive alloying elements. In addition, hot rolling of these steels does not produce a significant improvement in toughness. Namely, hot-rolled sheets of these steels exhibit a high ductile-brittle transition temperature. Therefore, it is necessary to apply warm rolling in place of cold rolling. This warm rolling is carried out at a temperature of around 150° C., for example, in order to produce a thin steel sheet and is more costly than cold rolling. Due to the cost of alloying elements and the difficulties involved in manufacturing the steel sheet, the resulting steel sheet is relatively expensive.

The same thing can be said on said Type 446 and Sicromal steels as far as the difficulties involved in manufacturing steel sheet are concerned.

Thus, there has been a great demand for a less expensive ferritic stainless steel which exhibits improved heat resistance, and particularly high-temperature oxidation and corrosion resistance.

Furthermore, since the use of high-sulfur oil has recently been increasing and that high temperature combustion, i.e. combustion in which metal components are heated to higher than 800° C. has recently been required for oil and kerosine stoves, there is all the more a need for a low-cost stainless steel exhibiting improved resistance to corrosion at high temperatures.

Such high-temperature articles as already mentioned are shaped through forming operation such as press-forming. Therefore, the steel sheet used for these purposes must have excellent formability as well as high-temperature oxidation and corrosion resistance.

PRIOR ART

Japan Patent Publication No. 27131/1980 discloses an Fe-Cr-Al steel containing less than 1.0% of Si, 15–25% Cr, 1–5% Al, 0.05–0.20% Nb, and a small amount of Ti. This publication teaches the employment of a warm rolling step after hot rolling so as to prevent cracking during cold rolling although it contains 0.05–0.20% of Nb.

Japan Laid-Open Specification No. 2328/1978 discloses a heat-resistant ferritic stainless steel which comprises 1–3% of Si, 15–26% of Cr and 0.5–2% of Nb. Since this reference states that the steel sheet has been manufactured through conventional hot and cold rolling, it is assumed that the steel sheet was produced through hot rolling with a finishing temperature of 880°–920° C., as is well known in the art.

Japan Laid-Open specification No. 2329/1978 also discloses a steel composition similar to that mentioned above except that it contains 0.007% or less of carbon and 5–15% of Cr for further improving weldability. The steel sheet of this reference is also produced using conventional manufacturing processes.

Japan Laid-Open Specifications Nos. 161049/1980 and 164967/1982 disclose a heat-resistant ferritic stainless steel which contains 1.5% or more of Si and Cr as well as Nb. However, the steel plates disclosed therein were also produced using conventional manufacturing processes. In particular, Laid-Open Specification No. 161049/1980 discloses the application of continuous casting and subsequent slight rolling prior to hot rolling in order to prevent cracking of cast slabs.

U.S. Pat. No. 4,374,683 discloses a process for producing a cold rolled steel sheet of an Nb-containing ferritic stainless steel having improved press-formability, which comprises hot rolling with a finishing temperature of 850° C. or less, annealing at a temperature of 950°–1050° C., cold rolling, and recrystallization annealing. It states that although the exact mechanism is not known, the lower the finishing temperature the higher the resistance to ridging, and that the effect of preventing the formation of ridging is significant only when the annealing temperature is 950° C. or higher. However, the Si content is not higher than 1.0%. This steel contains 0.1–2.0% of Cu so as to improve the resistance to pitting corrosion, i.e. wet corrosion. In that patent there is no reference to a steel containing a relatively large amount of Si, which has been thought to inevitably exhibit deterioration in toughness during or after hot rolling.

U.S. Pat. No. 4,360,381 discloses a cold rolled ferritic stainless steel sheet similar to that disclosed in U.S. Pat. No. 4,374,683, exhibiting further improved wet-corrosion resistance due to restriction of impurities including carbon, nitrogen, phosphorous, oxygen, and sulfur.

Since such prior art ferritic stainless steel sheets exhibit poor toughness after hot rolling when a large amount of Si is added to improve high-temperature corrosion resistance, it is inevitable that the hot-rolled sheet of a steel with a high Si content will cause cracking due to brittle fracture during cold rolling, uncoiling or recoiling prior to cold rolling, resulting in less productivity.

OBJECTS OF THE INVENTION

An object of this invention is to provide an inexpensive heat-resistant ferritic stainless steel sheet containing 1.5% or more by weight of Si which can exhibit improved toughness even after hot rolling.

Another object of this invention is to provide an inexpensive heat-resistant ferritic stainless steel sheet which is substantially free from the formation of a red oxide scale even when it is subjected to the combustion gases produced by the burning of fuel oils.

Still another object of this invention is to provide an inexpensive heat-resistant ferritic stainless steel, the maximum service temperature of which is 1000° C., much higher than that of AISI Type 430 steel, i.e. 800° C.

A further object of this invention is to provide an inexpensive heat-resistant ferritic stainless steel sheet, the high temperature strength of which is much higher than that of AISI Type 430 steel.

SUMMARY OF THE INVENTION

The inventors of this invention have carried out extensive study on the prior art problems mentioned hereinabove and have made the following observations.

(i) When hot rolling with a finishing temperature of 850° C. or less and subsequent annealing at a temperature of 820°-1000° C. are applied to a steel containing 5-20 times as much Nb as the total amount of carbon plus nitrogen (C%+N%), the toughness of the hot-rolled coil is unexpectedly and markedly improved, even in a steel which contains a relatively large amount of Si. This increase in toughness is remarkable because it has been thought that an increase in Si content inevitably results in a decrease in toughness, i.e. deterioration in workability, and many processes have been proposed to provide a high-Si steel with a satisfactory degree of ductility, although these prior art processes are not satisfactory from a practical and economical point of view.

The resulting steel sheet of this invention is substantially free from cracking caused by brittle fracture during uncoiling prior to cold rolling or during cold working (rolling, forming etc.) without warm forming. This means that it is not necessary to apply batch-type annealing (i.e. coil-annealing) to hot-rolled coil and it may be passed to a continuous annealing stage followed by a cold rolling stage. Therefore, productivity will be improved remarkably, and it is possible to eliminate a warm rolling step which adds to the manufacturing costs.

(ii) The application of hot rolling and annealing under the above mentioned conditions unexpectedly improves not only workability of hot-rolled coil, but also formability of cold-rolled sheet, even for steel compositions which contain relatively large amounts of Si and Cr.

(iii) The addition especially of Si as well as Cr improves the resistance to high temperature corrosion such as that occurring in a combustion gas atmosphere, e.g. in a combustion gas of a heating apparatus such as an oil stove. The addition of Si and Cr also improves the resistance to high-temperature corrosion under usual atmospheric conditions. Thus, since the formation of oxide scale on the surface is very small, when it is used as a combustion chamber wall, for example, it is expected that brightness can be kept for a long time. It is also suitable for use as a reflecting plate and the like which must have a satisfactory resistance to high-temperature oxidation and corrosion.

This invention resides in a process for producing heat-resistant ferritic stainless steel sheet which exhibits improved toughness and ease of manufacture, which comprises the steps of:

(a) hot rolling a steel with a finishing temperature of not higher than 850° C., said steel comprising, by weight %;

C: not more than 0.07%,
Si: 1.5-3.5%,
Mn: not more than 2.0%,
Cr: 10-25%,
N: not more than 0.05%,
Nb: 5X(C%+N%)-20X(C%+N%),
optionally at least one element selected from the group consisting of Al, Y, Ca, and REM in a total amount of 0.3% or less, and the balance iron and incidental impurities, and (b) annealing the resulting hot-rolled steel sheet at a temperature of 820°-1000°.

In one aspect of this invention, the annealed hot-rolled steel sheet may be subjected to cold rolling to provide a cold-rolled steel sheet with improved press-formability.

The steel preferably comprises, by weight %:

C: not more than 0.02%,
Si: 2.0-3.5%,
Mn: not more than 0.5%,
Cr: 15-20%,
N: not more than 0.03%,
Nb: 7X(C%+N%)-15X(C%+N%), usually 0.25-0.50%
optionally at least one element selected from the group consisting of Al, Y, Ca, and REM in a total amount of 0.3% or less, and
the balance iron and incidental impurities.

DETAILED DESCRIPTION OF PREFERRED EMBODIMENTS

Figure 1:
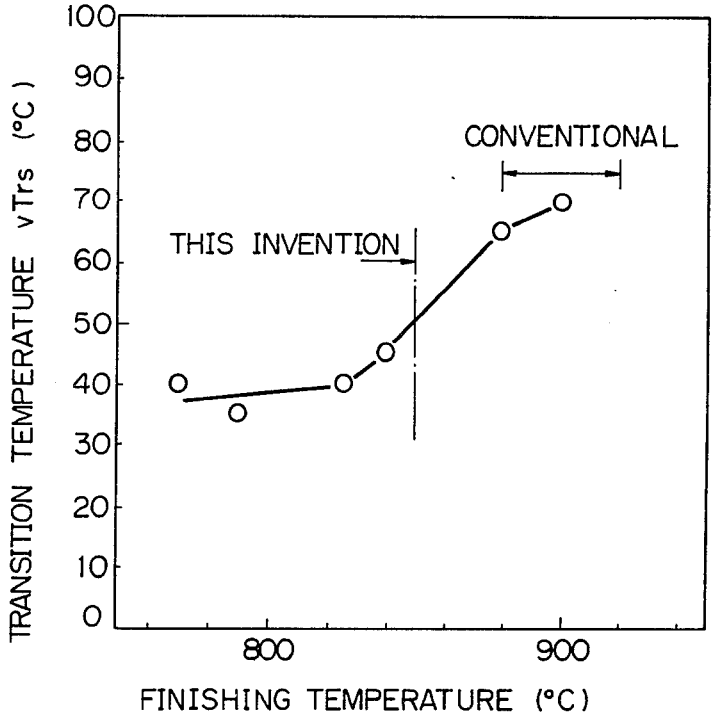
FIG. 1 is a graph showing the relationship between the transition temperature (vTrs) and the hot rolling finishing temperature.

The reasons why the steel composition and manufacturing conditions of this invention are as defined above will now be given. Unless otherwise indicated, the term "%" means "% by weight" in this specification.

Carbon (C):

Carbon is an element which generally has an adverse effect on high-temperature resistance to oxidation. When carbon is added in an amount of more than 0.07%, formability as well as workability deteriorate, resulting in so-called hot coil brittleness. When 0.07% or more of C is contained in steel, weldability is also impaired because transformation into martensite takes place upon the steel being cooled after welding. According to this invention, the carbon content is restricted to not more than 0.07%, preferably to not more than 0.02%.

Silicon (Si):

Silicon plays an important roll in this invention in order to improve high-temperature oxidation and corrosion resistance. Such an effect is not expected when Si is added in an amount of less than 1.5%. On the other hand, when it is added in an amount of more than 3.5%, the hardening of steel structure becomes remarkable, and productivity and formability are thereby impaired. According to this invention, therefore, the Si content is defined as 1.5%–3.5%, preferably 2.0–3.5%.

Manganese (Mn):

When manganese is added in an amount of more than 2.0%, extreme hardening of steel structure takes place, and productivity deteriorates. High-temperature corrosion resistance is also impaired when too much manganese is added. According to this invention, manganese is added in an amount of not more than 2.0%, preferably not more than 0.5%.

Chromium (Cr):

Like Si, Cr is an essential element for improving high-temperature oxidation and corrosion resistance. When Cr is added in an amount of less than 10%, improvement in high-temperature oxidation and corrosion resistance is not satisfactory. On the other hand, when it is more than 25%, the formability of the steel deteriorates.

Nitrogen (N):

When more than 0.05% of nitrogen is added, the formability as well as workability deteriorate remarkably, just as when too much carbon is added. Preferably, nitrogen is restricted to not more than 0.03%.

Niobium (Nb):

Niobium is an important element in this invention. It combines with carbon and nitrogen to stabilize the steel structure. The incorporation of niobium is also slightly effective to eliminate coloring due to oxidation in a high-temperature atmosphere. However, it is to be noted that the addition of 5–20 times as much niobium as the total amount of carbon plus nitrogen (C%+N%) can successfully improve workability as well as formability of high-Si, high-Cr steels when hot rolling with a finishing temperature of 850° C. or lower and subsequent annealing treatment at a temperature of 820°–1000° C. are carried out. Unexpectedly, the addition of Nb combined with the above-mentioned low temperature finishing can successfully prevent brittleness of the resulting hot coil, namely it can remarkably improve the toughness of a hot rolled steel sheet in spite of the fact that the steel contains relatively large amounts of Si and Cr. This means that cracking due to brittle fracture does not occur during uncoiling or recoiling prior to cold rolling even for a high-Si, high-Cr steel. Thus, according to this invention, productivity can be remarkably improved. Such an improvement in formability and productivity cannot be obtained if Ti or Zr is added in place of Nb, although Ti and Zr are also used as stabilizing elements. The mechanism by which niobium can successfully improve toughness of steel sheet is totally different from that expected when Ti or Zr is added in place of Nb. Furthermore, when Nb is added, the lasting surface is free from any surface defects, resulting in a satisfactory yield. This advantage is not obtained when Ti or Zr is added.

Thus, the addition of niobium can help decrease the cost of producing steel sheet with improved properties. When niobium is added in an amount of less than 5 times (C%+N%), or in an amount of more than 20 times (C%+N%), the intended effect of niobium addition cannot be achieved. Preferably, the amount of niobium added is 7–15 times the total amount of (C%+N%).

Al, Ca, Y, Rare Earth Metals (REM):

Though the steel composition mentioned above is effective to improve toughness, the steel utilized in this invention may optionally contain at least one element selected from the group consisting of Al, Ca, Y, and REM (rare earth metals) so as to further improve the adhesion of oxide scale, i.e. high-temperature oxidation resistance, when the steel is intended to be used in a high-temperature atmosphere.

When the total mount of these optional elements is more than 0.3%, the formability of the resulting steel sheet deteriorates. Thus, the upper limit of these optional elements is 0.3%. Preferably, Al is added in an amount of not more than 0.3%, and the other elements, such as Ca, Y, and REM are added each in an amount of 0.05% or less.

Finishing Temperature of Hot Rolling:

When the amount of niobium added is 5–20 times the total amount of (C%+N%) and hot rolling is carried out with a finishing temperature which is not higher than 850° C., fine carbo-nitrides of niobium are precipitated, and the resulting hot-rolled steel sheet exhibits improved toughness. Simultaneously, the amount of strain introduced and accumulated in the steel sheet during hot rolling increases. Therefore, the steel structure thus obtained is suitable for carrying out the preceeding annealing treatment at a temperature of 820°–1000° C. so as to form a steel structure of fine crystal grains, even though it contains a relatively large amount of Si.

It is thought that according to U.S. Pat. No. 4,374,683 press-formability is improved due to the formation of crystal grains dispersed at random. On the other hand, toughness of a hot rolled sheet of steel containing a large amount of Si together with Nb is markedly improved in accordance with this invention because very fine crystal grains are formed during the annealing following hot rolling. As already mentioned, the inventors of this invention have found that the addition of Nb is effective for such purposes.

Annealing Temperature After Hot Rolling:

According to the manufacturing process of this invention, the hot rolling is carried out with a finishing temperature of 850° C. or less and then annealing is performed at a temperature of 820°–1000° C. When the annealing is carried out at a temperature of lower than 820° C., the steel structure is not softened thoroughly, so that cold rolling may not be applied easily. On the other hand, when the temperature is higher than 1000° C., the crystal grains grow coarse, resulting in a decrease in toughness.

Short time annealing, i.e. continuous annealing at a temperature of 850°–1000° C., or long-period annealing (coil annealing) at a temperature of 820°–850° C. is preferable from a practical point of view.

The hot-rolled steel sheet thus manufactured has a fine crystal structure with improved toughness and it also has crystal grains dispersed at random directions, resulting in improved workability as well as formability after cold rolling. Cold rolling is not necessarily applied to the steel sheet obtained in accordance with this invention. However, when it is applied, the cold rolled steel strip is preferably subjected to annealing prior to the cold rolling or during cold rolling at a temperature of 850°–1000° C., preferably 900°–1000° C., which is higher than the usual annealing temperature for conventional ferritic stainless steel, i.e. 830°–850° C., for further improving formability as well as workability of the resulting cold-rolled steel strip.

This invention will be described in conjunction with some working examples, which are presented merely for illustrative purposes and are not intended to be restrictive in any way.

EXAMPLES

Steels having the chemical compositions shown in Table 1 were prepared and hot-rolled to steel sheets 6 mm thick under the conditions shown in Table 1. The hot-rolled coils thus obtained were subjected to a toughness test. After cold rolling to a thickness of 0.8 mm, other coils were subjected to a corrosion resistance test, a formability and workability test, a high-temperature corrosion test and a high-temperature strength test.

The test data are summarized in Tables 1, 2, 3, and 4 together with hot rolling and annealing conditions.

(1) Toughness Test of Hot Rolled Coil:

From as-hot-rolled coils 6 mm thick prepared as described above, half-size Charpy test pieces (5 mm thick×10 mm wide×55 mm long) with a V-notch (2 mm deep) were cut. A Charpy test was carried out to determine the transition temperature (vTrs) and the temperature at which the Charpy impact value was 3 kgf-m/cm$^2$ ($vTr_{(3kgf-m)}$). The test results are summarized in Table 1.

For as-hot-rolled steel sheets prepared in accordance with this invention, the value of vTrs was 100° C. or lower and the value of $vTr_{(3kgf-m)}$ was 30° C. or lower. This means that there is no cracking when the sheet is coiled and uncoiled under usual conditions. Thus, it is empirically expected that the steel sheet thus obtained will successfully be subjected to uncoiling and recoiling under cold working conditions.

Comparative Steels No. 14 (Cr=9.1%) and No. 15 (Si=1.4%) exhibited satisfactory toughness since the content of Si or Cr of these steels was small. However, Steels No. 16–21 exhibited values of vTrs and $vTr_{(3kgf-m)}$ higher than those of steels of this invention. This is because in these comparative steels the finishing temperature was higher than 850° C. or the Nb content fell outside of the range of this invention. Steel No. 22 shows the case where the hot rolling was finished at a temperature higher than the transformation temperature, and it had a high transition temperature. Steel No. 22 is conventional AISI Type 430 steel.

Some of the steel sheets shown in Table 1 were then subjected to annealing at the temperatures indicated in Table 2 for 10 minutes. A Charpy test was carried out in the same manner as in the above. The test results are also shown in Table 2.

Steels No. 1, 4, and 8 fell within the range of this invention in the alloy composition and were prepared through hot rolling under the conditions of this invention. As is apparent from the data shown in Table 2, when the annealing temperature was as high as 1050° C., the transition temperature of the resulting steel was high (see Steel No. 1). Steels No. 16, 17, and 21 were comparative steels. The alloy composition and hot rolling finishing temperature of Steels No. 16, 17, and 21 fell outside of the range of this invention, and they had transition temperatures higher than 100° C. Steel No. 22 corresponds to AISI Type 430 steel which had a low Charpy transition temperature. However, Steel No. 23 corresponding to AISI Type 446 steel exhibited a high transition temperature.

In contrast, Steels No. 1, 4, and 8 which had steel compositions within the range of this invention and were processed in accordance with this invention all exhibited a Charpy transition temperature at substantially the same level as AISI Type 430 steel. The as-hot-rolled sheets thus obtained were free from cracking due to brittle fracture during cold rolling and during working. Therefore, it is apparent that the productivity can be much improved in accordance with this invention.

FIG. 1 is a graph showing the relationship between the transition temperature (vTrs) and the hot rolling finishing temperature. The test was carried out using Steel No. 4 in Table 1, which was annealed at 960° C. for 10 minutes after hot rolling. As is apparent from the graph, the vTrs is lower than 50° C. when the finishing temperature is 850° C. or lower. Thus, it has been empirically determined that cold rolling and working can successfully be applied to the steel sheet thus produced with being free from cracking.

Figure 2:
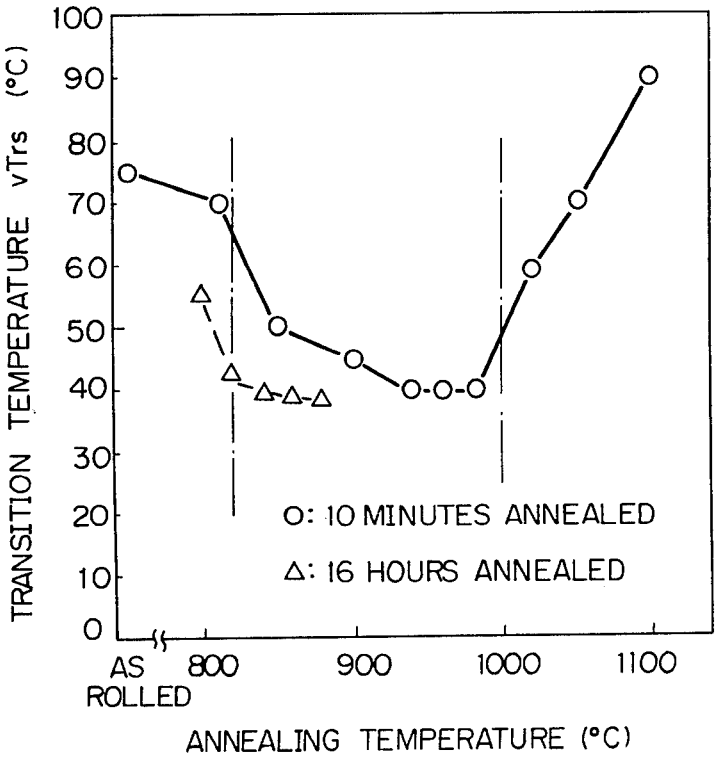
FIG. 2 is a graph showing the relationship between the Charpy transition temperature and annealing temperature after hot rolling.

FIG. 2 is a graph showing the relationship between Charpy transition temperature and annealing temperature after hot rolling. The test was carried out using Steel No. 4 in Table 1, which was hot rolled with a finishing temperature of 770° C. and then subjected to annealing at a variety of temperatures. As is apparent from the data shown in FIG. 2, the transition temperature was relatively low when the annealing temperature was within the range of 820° to 1000° C. It is to be noted that a longer period of annealing is preferable when the annealing temperature is lower than 900° C.

(2) Workability, Formability Test:

Hot rolled steel sheets 5 mm thick were obtained in the same manner as shown in Table 1 below and were annealed at the temperatures indicated in Table 3. The annealed hot-rolled coil was then subjected to conventional cold rolling and then continuous annealing at a temperature of 970° C. This process involving cold rolling and subsequent annealing was repeated twice to provide a cold-rolled steel strip 0.8 mm thick. A tensile strength test and Erichsen test were carried out using test pieces cut from the above-mentioned cold-rolled steel strip. For the tensile strength test, ASTM 13B test pieces were used.

The test results are summarized in Table 3. As is apparent from the data shown in Table 3, Steels No. 1–8 which were within the range of this invention and Steels No. 14, 15, and 22 which contained a relatively low amount of Si or Cr exhibited an elongation of 28% or more and an Erichsen value of 9 or more. On the other hand, Steels No. 16–21 and 23, which were comparative steels, exhibited a small elongation value as well as unsatisfactory Erishcen values. The cold-rolled steel strip prepared in accordance with this invention showed good results, whether continuously annealed or coil annealed.

(3) High Temperature Corrosion Resistance Test:

Test pieces 10 mm wide and 20 mm long were cut from the above mentioned cold-rolled steel strip and the surface thereof was ground with #1200 emery paper and pickled with a nitric-fluoric acid. The test pieces thus prepared were tested in the following two ways for high-temperature oxidation and corrosion resistance:

(i) Kerosine Stove Test:

A test piece was placed on a burner head (600°–650° C.) of a commercial kerosine fan heater for 100 hours. Thus, it was in a combustion gas atmosphere at a temperature of 600°–650° C. for 100 hours. The surface of the test piece was examined after testing. When a red-oxide scale was formed, this was indicated by an "X" in Table 4, and when there was no oxidation but the surface was temper-colored, this was indicated by an "O" in the same table.

(ii) Oxidation Test In Air:

A continuous oxidation test was carried out using test pieces placed within an electric furnace of the horizontal type. These test pieces were kept at temperatures each differed by 50° C. in the range of from 800° C. to 1100° C. for 250 hours. The temperature at which abnormal oxidation took place causing local or overall swelling or at which weight loss due to oxidation reached 10 mg/cm$^2$ was called the "maximum service temperature".

The test results are summarized in Table 4. As is apparent from the data shown in Table 4, the test steels except for Steels No. 14, 15, and 22 contained a large amount of Cr and Si and exhibited improved resistance to oxidation in air in comparison with those steels not containing these elements. In particular, Steels No. 9–13 which contained at least one of Al, Ca, Y, and REM exhibited improved resistance to oxidation in air in comparison with steels not containing these elements.

Table 4 also shows experimental data of tensile strength at 700° C., which were obtained by carrying out a high-temperature tensile strength test in which ASTM 13B test pieces were heated to 900° C. It is noted that the addition of Si, Cr and Nb carried out in accordance with this invention increased high temperature strength. In particular, the addition of Nb was remarkably effective to increase the strength. The steel sheets of this invention exhibited high-temperature strength higher than that of AISI Type 430 steel (see Steel No. 22). Thus, the steel sheets of this invention will be advantageously used to prevent distortion while in service at a high temperature atmosphere.

Although this invention has been described with respect to preferred embodiments it is to be understood that variations and modifications may be employed without departing from the concept of this invention as defined in the following claims.

TABLE 1

| Steel No. | C | Si | Mn | Cr | Nb | N | Others | Finishing Temp. (°C.) | Charpy Test vTrs (°C.) | Charpy Test vTr (3 Kgf-m) (°C.) | Remarks |
|---|---|---|---|---|---|---|---|---|---|---|---|
| 1 | 0.060 | 1.82 | 0.56 | 11.02 | 0.55 | 0.035 | — | 800 | 95 | 25 | This Invention |
| 2 | 0.015 | 3.20 | 0.69 | 10.75 | 0.31 | 0.020 | — | 820 | 90 | 30 | |
| 3 | 0.015 | 2.45 | 0.42 | 15.15 | 0.40 | 0.020 | — | 780 | 65 | 20 | |
| 4 | 0.025 | 2.51 | 0.31 | 18.12 | 0.35 | 0.025 | — | 770 | 75 | 25 | |
| 5 | 0.010 | 3.09 | 0.26 | 18.06 | 0.15 | 0.015 | — | 810 | 60 | 15 | |
| 6 | 0.010 | 2.44 | 0.33 | 18.03 | 0.54 | 0.020 | — | 830 | 75 | 20 | |
| 7 | 0.020 | 2.10 | 0.32 | 20.15 | 0.35 | 0.025 | — | 840 | 60 | 20 | |
| 8 | 0.015 | 1.67 | 0.31 | 23.30 | 0.66 | 0.040 | — | 830 | 60 | 20 | |
| 9 | 0.015 | 2.05 | 0.31 | 18.06 | 0.41 | 0.025 | Al = 0.25 | 810 | 60 | 15 | |
| 10 | 0.018 | 2.45 | 0.33 | 18.21 | 0.45 | 0.018 | Ca = 0.005 | 800 | 70 | 20 | |
| 11 | 0.021 | 2.51 | 0.29 | 18.15 | 0.44 | 0.020 | Y = 0.01 | 810 | 70 | 25 | |
| 12 | 0.022 | 2.46 | 0.27 | 18.03 | 0.43 | 0.035 | Ce = 0.005 | 790 | 90 | 30 | |
| 13 | 0.017 | 2.01 | 0.30 | 18.11 | 0.42 | 0.019 | Ca = 0.005<br>Ce = 0.005 | 800 | 75 | 25 | |
| 14 | 0.010 | 2.20 | 0.55 | 9.10 | 0.33 | 0.010 | — | 800 | 50 | 10 | Comparative Examples |
| 15 | 0.015 | 1.40 | 0.57 | 11.03 | 0.28 | 0.010 | — | 810 | 65 | 15 | |
| 16 | 0.015 | 2.30 | 0.52 | 11.10 | — | 0.015 | — | 900 | 155 | 70 | |
| 17 | 0.025 | 2.45 | 0.32 | 18.05 | — | 0.015 | — | 830 | 165 | 65 | |
| 18 | 0.010 | 2.98 | 0.34 | 18.11 | 0.64 | 0.015 | — | 820 | 110 | 45 | |
| 19 | 0.015 | 1.70 | 0.31 | 23.10 | 0.41 | 0.055 | — | 870 | 160 | 70 | |
| 20 | 0.020 | 2.51 | 0.33 | 18.10 | 0.10 | 0.015 | — | 840 | 110 | 50 | |
| 21 | 0.090 | 2.03 | 0.40 | 20.13 | 0.99 | 0.035 | — | 845 | 155 | 75 | |
| 22 | 0.051 | 0.50 | 0.44 | 16.76 | — | 0.015 | — | 890 | 110 | 55 | AISI 430 |
| 23 | 0.15 | 0.71 | 0.94 | 24.96 | — | 0.180 | — | 870 | — | — | AISI 446 |

TABLE 2

| Steel No. | Annealing Temp. (°C.) | Charpy Transition Temp. (vTrs, °C.) | Remarks |
|---|---|---|---|
| 1 | 850 | 45 | Invention |
| | 1050 | 135 | Comparative |
| 4 | 960 | 40 | Invention |
| 8 | 935 | 45 | " |
| 16 | 910 | 135 | Comparative |
| 17 | 930 | 150 | " |
| 21 | 920 | 155 | " |
| 22 | 830 | 40 | Conventional |
| 23 | 880 | 170 | " |

TABLE 3

| Steel No. | 1 | 2 | 3 | 4 | 5 | 6 | 7 | 8 | 9 | 10 | 11 | 12 |
|---|---|---|---|---|---|---|---|---|---|---|---|---|
| Annealing Temp. (°C.) | 830 | 830 | 930 | 960 | 930 | 930 | 830 | 830 | 930 | 930 | 930 | 930 |
| Annealing Time | 8 hr | 1 hr | 1 min | 5 min | 5 min | 5 min | 8 hr | 16 hr | 10 min | 10 min | 10 min | 10 min |
| Elongation (%) | 32.0 | 31.5 | 32.1 | 30.5 | 28.6 | 29.1 | 29.5 | 30.3 | 29.6 | 30.5 | 31.0 | 29.6 |
| Erichsen Value | 9.5 | 9.6 | 9.4 | 9.3 | 9.3 | 9.3 | 9.4 | 9.2 | 9.2 | 9.3 | 9.0 | 9.1 |

| Steel No. | 13 | 14 | 15 | 16 | 17 | 18 | 19 | 20 | 21 | 22 | 23 |
|---|---|---|---|---|---|---|---|---|---|---|---|
| Annealing Temp. (°C.) | 930 | 930 | 930 | 930 | 930 | 930 | 930 | 930 | 930 | 830 | 880 |
| Annealing Time | 10 min | 1 min | 1 min | 1 min | 5 min | 5 min | 10 min | 5 min | 10 min | 16 hr | 16 hr |
| Elongation (%) | 29.5 | 33.0 | 31.5 | 26.5 | 25.5 | 23.6 | 27.3 | 26.5 | 20.6 | 31.0 | 23.5 |
| Erichsen | 9.0 | 10.5 | 9.7 | 8.3 | 8.0 | 8.5 | 8.1 | 8.7 | 8.0 | 10.0 | 7.3 |

TABLE 3-continued

| Value |
|---|

Note:
An annealing time of 1–10 minutes means the annealing was carried out in a continuous manner.
An annealing time of 1–16 hours means the annealing was batch type annealing (coil annealing).

TABLE 4

| Steel No. | Kerosine Stove Test | Maximum Service Temp. (°C.) | Tensile Strength at 700° C. (kgf/mm$^2$) |
|---|---|---|---|
| 1 | O | 1000 | 13.1 |
| 2 | O | 1000 | 15.5 |
| 3 | O | 1050 | 16.4 |
| 4 | O | 1050 | 17.0 |
| 5 | O | 1100 | 17.3 |
| 6 | O | 1050 | 17.3 |
| 7 | O | 1050 | 18.2 |
| 8 | O | 1050 | 19.9 |
| 9 | O | 1050 | 18.0 |
| 10 | O | 1100 | 17.5 |
| 11 | O | 1100 | 17.9 |
| 12 | O | 1100 | 17.6 |
| 13 | O | 1100 | 17.5 |
| 14 | X | 850 | 9.6 |
| 15 | X | 900 | 10.8 |
| 16 | O | 1000 | 6.5 |
| 17 | O | 1050 | 10.2 |
| 18 | O | 1100 | 18.9 |
| 19 | O | 1050 | 18.0 |
| 20 | O | 1050 | 16.8 |
| 21 | O | 1000 | 18.8 |
| 22 | X | 800 | 9.0 |
| 23 | O | 1050 | — |

What is claimed is:

1. A process for producing heat-resistant ferritic stainless steel sheet which exhibits improved toughness and productivity, which comprises the steps of:
   hot rolling a steel with a finishing temperature of not higher than 850° C. said steel comprising, by weight %,
   C: not more than 0.07%,
   Si: 1.5–3.5%,
   Mn: not more than 2.0%,
   Cr: 10–25%,
   N: not more than 0.05%,
   Nb: 5X(C%+N%)–20X(C%+N%),
   optionally at least one element selected from the group consisting of Al, Y, Ca, and REM in a total amount of 0.3% or less, and
   the balance iron and incidental impurities; and
   annealing the resulting hot-rolled steel sheet at a temperature of 820°–1000° C.

2. A process as defined in claim 1, in which the hot-rolled steel sheet is annealed at a temperature of 850°–1000° C.

3. A process as defined in claim 1, in which the hot-rolled steel sheet is annealed at a temperature of 820°–850° C.

4. A process as defined in claim 1, in which said steel comprises, by weight %:
   C: not more than 0.02%,
   Si: 2.0–3.5%,
   Mn: not more than 0.5%,
   Cr: 15–20%,
   N: not more than 0.03%,
   Nb 7X(C%+N%)–15X(C%+N%),
   optionally at least one element selected from the group consisting of Al, Y, Ca, and REM in a total amount of 0.3% or less, and
   the balance iron and incidental impurities.

5. A process for producing heat-resistant ferritic stainless steel sheet which exhibits improved toughness and productivity, which comprises the steps of:
   hot rolling a steel with a finishing temperature of not higher than 850° C. said steel comprising, by weight %,
   C: not more than 0.07%,
   Si: 1.5–3.5%,
   Mn: not more than 2.0%,
   Cr: 10–25%,
   N: not more than 0.05%,
   Nb: 5X(C%+N%)–20X(C%+N%),
   optionally at least one element selected from the group consisting of Al, Y, Ca, and REM in a total amount of 0.3% or less, and
   the balance iron and incidental impurities;
   annealing the resulting hot-rolled steel sheet at a temperature of 820°–1000° C.; and
   cold rolling the resulting annealed hot-rolled steel sheet.

6. A process as defined in claim 5, in which the hot-rolled steel sheet is annealed at a temperature of 850°–1000° C.

7. A process as defined in claim 5, in which the hot-rolled steel sheet is annealed at a temperature of 820°–850° C.

8. A process as defined in claim 5, in which said steel comprises, by weight %:
   C: not more than 0.02%,
   Si: 2.0–3.5%,
   Mn: not more than 0.5%,
   Cr 15–20%,
   N: not more than 0.03%,
   Nb: 7X(C%+N%)–15X(C%+N%),
   optionally at least one element selected from the group consisting of Al, Y, Ca, and REM in a total amount of 0.3% or less, and
   the balance iron and incidental impurities.

9. A heat-resistant ferritic stainless steel sheet which is produced by the process defined in claim 1.

10. A heat-resistant ferritic stainless steel sheet which is produced by the process defined in claim 5.

* * * * *